US007246964B2

(12) United States Patent
Thomas

(10) Patent No.: US 7,246,964 B2
(45) Date of Patent: Jul. 24, 2007

(54) NOTE PEN

(76) Inventor: Marcell Thomas, 3220 Avenue H, Apt. 5B, Brooklyn, NY (US) 11210

( * ) Notice: Subject to any disclaimer, the term of this patent is extended or adjusted under 35 U.S.C. 154(b) by 0 days.

(21) Appl. No.: 11/115,893

(22) Filed: Apr. 27, 2005

(65) Prior Publication Data

US 2005/0274769 A1 Dec. 15, 2005

Related U.S. Application Data

(63) Continuation-in-part of application No. 10/866,558, filed on Jun. 9, 2004, now Pat. No. 6,981,813.

(51) Int. Cl.
*B43K 29/00* (2006.01)

(52) U.S. Cl. ..... 401/195

(58) Field of Classification Search ..... 401/52, 401/195

See application file for complete search history.

(56) References Cited

U.S. PATENT DOCUMENTS 2,301,364 A * 11/1942 Bruck et al. ..... 401/52
2,512,168 A * 6/1950 Moore ..... 206/389
3,963,358 A 6/1976 Houser
4,872,775 A 10/1989 Chang
6,135,661 A * 10/2000 Houser ..... 401/195
6,283,661 B1 9/2001 Connors

* cited by examiner

*Primary Examiner*—David J. Walczak
(74) *Attorney, Agent, or Firm*—Law Offices of Alozie N. Etufugh PLLC

(57) ABSTRACT

A note pen paper system, which includes a roller assembly having an elongated tube member and a knob member. The elongated tube member has a first and second end, where the knob member is coupled to the first end of the elongated tube member. The knob member has a bore extending therethrough where the bore is aligned with a center of the elongated tube member. A pen member is slideably receivable in the knob member and the elongated tube member with a writing tip extends from the bore of the knob member. The pen member is removable from the roller assembly for use. A capholder member is configured to hold the elongated tube member in place in the roller assembly.

11 Claims, 8 Drawing Sheets

NOTE PEN

CROSS-REFERENCE TO RELATED APPLICATION

This application is a continuation in part of U.S. patent application Ser. No. 10/866,558 filed on Jun. 9, 2004 U.S. Pat. No. 6,981,813, entitled "NotePen" which issued on Jan. 3, 2006 and is herein incorporated by reference.

FIELD OF THE INVENTION

This invention relates to pens and pencils and more particularly pertains to a new pen and rolled note paper system for providing notepaper and a pen in a single unit.

BACKGROUND OF THE INVENTION

The use of pens and pencil with paper is known in the prior art. More specifically, pens and pencils heretofore devised and utilized are known to consist basically of familiar, expected and obvious structural configurations, notwithstanding the myriad of designs encompassed by the crowded prior art which have been developed for the fulfillment of countless objectives and requirements.

Illustrative examples include U.S. Pat. No. 4,872,775; U.S. Pat. No. 6,135,661; and U.S. Pat. No. 6,247,864.

In these respects, the pen and rolled note paper system according to the present invention substantially departs from the conventional concepts and designs of the prior art, and in so doing provides an apparatus primarily developed for the purpose of providing notepaper and a pen in single unit.

BRIEF SUMMARY OF THE INVENTION

The present invention has been accomplished in view of the above-mentioned technical background, and it is an object of the present invention to provide a pen and rolled note paper system.

In a preferred embodiment of the invention, a note paper system is disclosed, which includes a roller assembly having an elongated tube member and a knob member. The elongated tube member has a first and second end, where the knob member is coupled to the first end of said elongated tube member. The knob member has a bore extending therethrough where the bore is aligned with a center of the elongated tube member. A pen member is slideably receivable in the knob member and the elongated tube member with a writing tip extends from the bore of the knob member. The pen member is removable from the roller assembly for use. A capholder member is configured to hold the elongated tube member in place in the roller assembly.

In another preferred embodiment of the invention, a note paper device is disclosed, which includes a housing configured to hold a roller assembly, where the housing includes a slot. A paper roll is positioned around the roller assembly, where the paper roll is configured to be rolled in and out of the slot of the housing. The roller assembly has an elongated tube member and a knob member. The elongated tube member has a first and second end, wherein the knob member is coupled to the first end of the elongated tube member. The knob member has a bore extending therethrough where the bore is aligned with a center of the elongated tube member. A pen member is slideably receivable in the knob member and the elongated tube member with a writing tip extended from the bore of the knob member. The pen member is removable from said roller assembly for use. A capholder member configured to hold the elongated tube member in place in the roller assembly.

In yet another preferred embodiment of the invention, a note paper device is disclosed. In the note paper device, a housing is configured to hold a roller assembly, where the housing includes a slot. A paper roll surrounds the roller assembly, where the paper roll is configured to be rolled in and out of the slot of the housing. The roller assembly has an elongated tube member and a knob member. The elongated tube member has a first and second end, where the knob member is coupled to the first end of the elongated tube member. The knob member has a bore extending therethrough where the bore is aligned with a center of the elongated tube member. A pen member is slideably receivable in the knob member and the elongated tube member with a writing tip extended from the bore of the knob member. The pen member is removable from the roller assembly for use. A capholder member is configured to hold the elongated tube member in place in the roller assembly. A cap member configured to protect the pen member.

BRIEF DESCRIPTION OF SEVERAL VIEWS OF THE DRAWINGS

These and other advantages of the present invention will become more apparent as the following description is read in conjunction with the accompanying drawings, wherein.

DETAILED DESCRIPTION OF THE INVENTION

Figure 1:
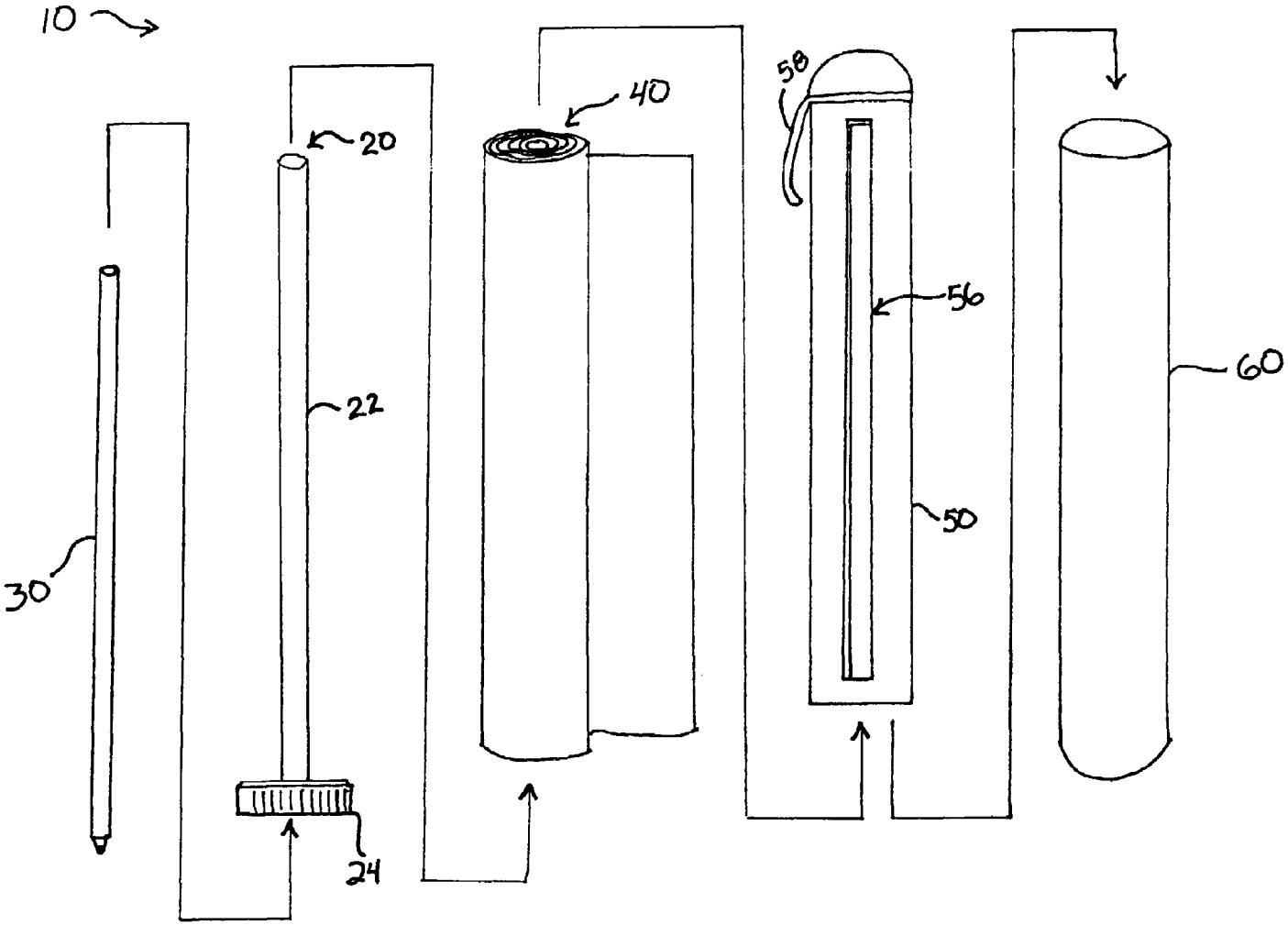
FIG. 1 is a schematic exploded front perspective view of a new pen and rolled not paper system in accordance with the invention.

With reference now to the drawings, and in particular to FIGS. 1 through 4 thereof, a new pen and rolled note paper system embodying the principles and concepts of the present invention and generally designated by the reference numeral 10 will be described.

As best illustrated in FIGS. 1 through 4D, the pen and rolled note paper system 10 generally comprises a roller assembly 20, a pen member 30, a paper roll 40, a housing 50, and a capholder member 62.

The roller assembly 20 preferably further comprises an elongated tube member 22 and a knob member 24. The elongated tube member 22 is hollow and substantially cylindrical. The elongated tube member 22 has a first end and a second end. The knob member 24 is preferably operationally coupled to the first end of the elongated tube member 22. The knob member 24 has a bore extending therethrough which is aligned with the hollow center of the elongated tube member 22. Preferably, the knob member 24 has a knurled or ridged perimeter wall to facilitate being grasped by a human hand. The knob member 24 moves forward to allow the paper roll 40 to be written on and backwards to manually store the written information. Also, the movement of knob member 24 allows the elongated tube member 22 to be unscrewed from the knob member 24.

Figure 2:
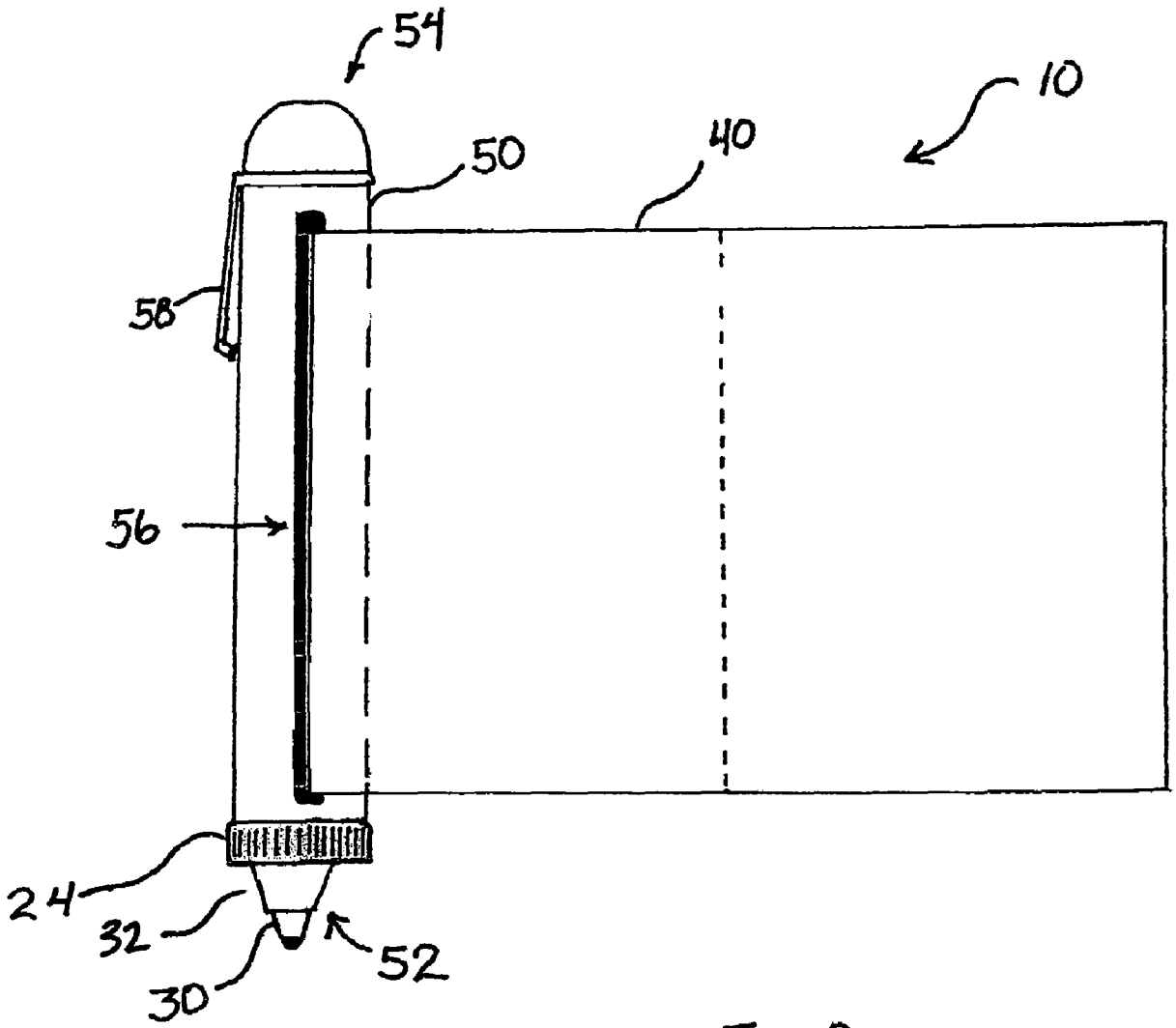
FIG. 2 is a schematic perspective view of FIG. 1 in accordance with the invention.
Figure 3:
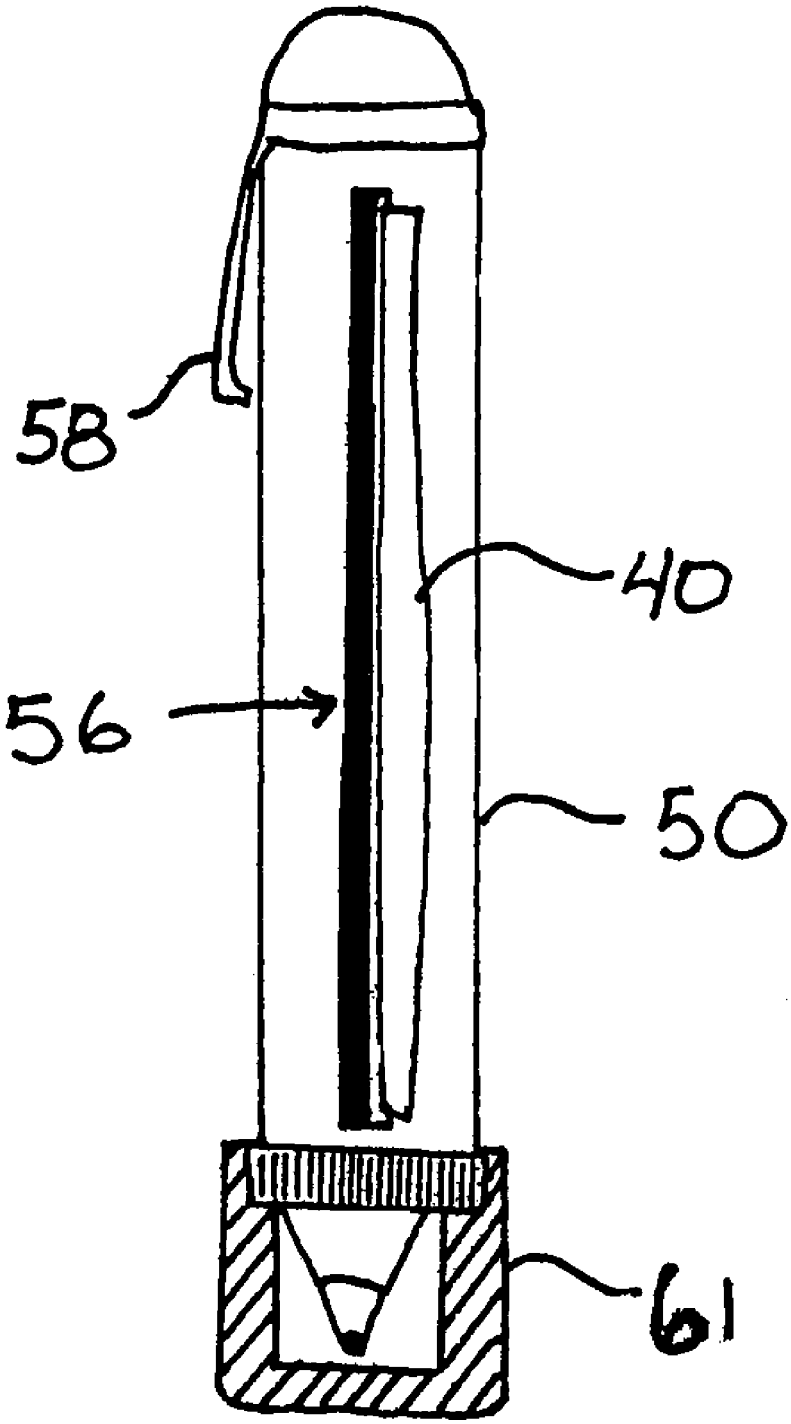
FIG. 3 is another schematic perspective view of FIG.1 in accordance with the invention.
Figure 4A:
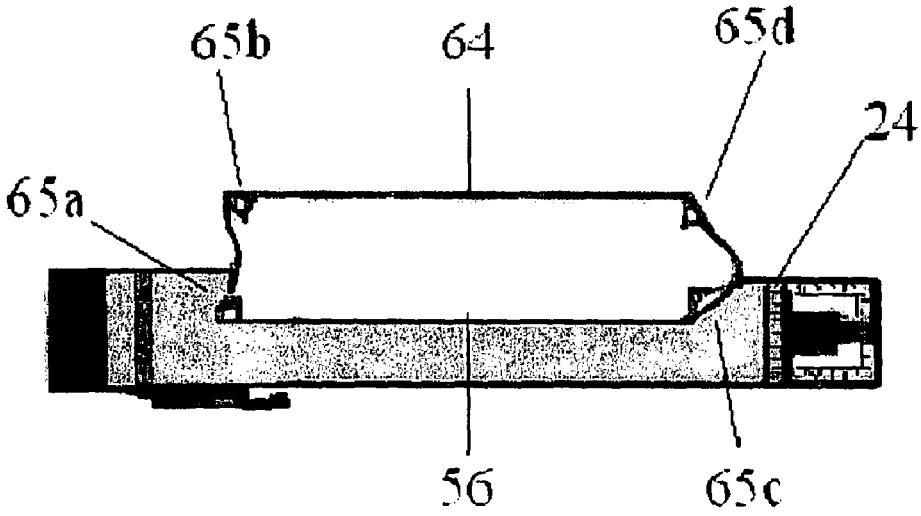
FIGS. 4A through 4E are additional schematic perspective views of FIG. 1 or parts of FIG. 1 in accordance with the invention.
Figure 4B:
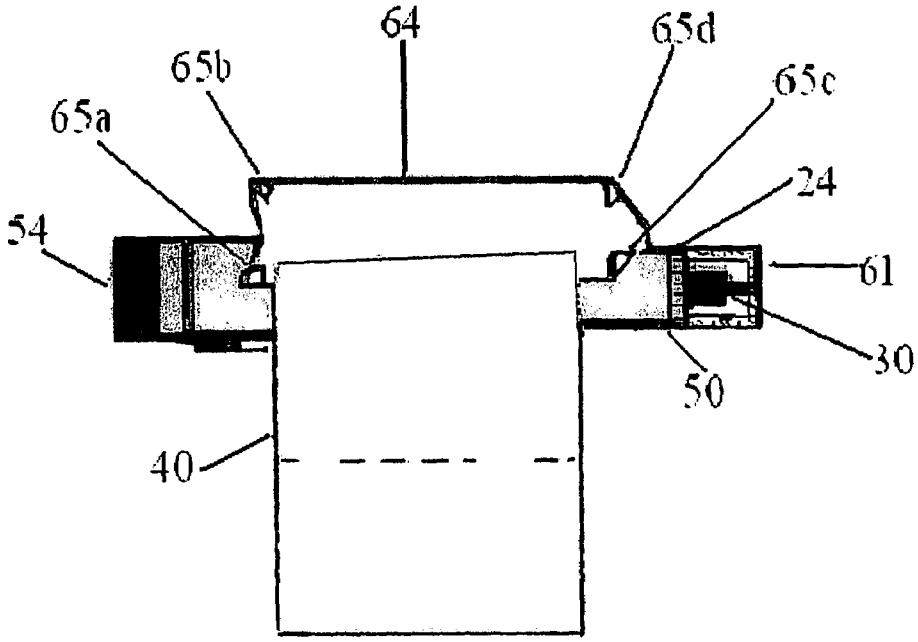
Figure 4C:
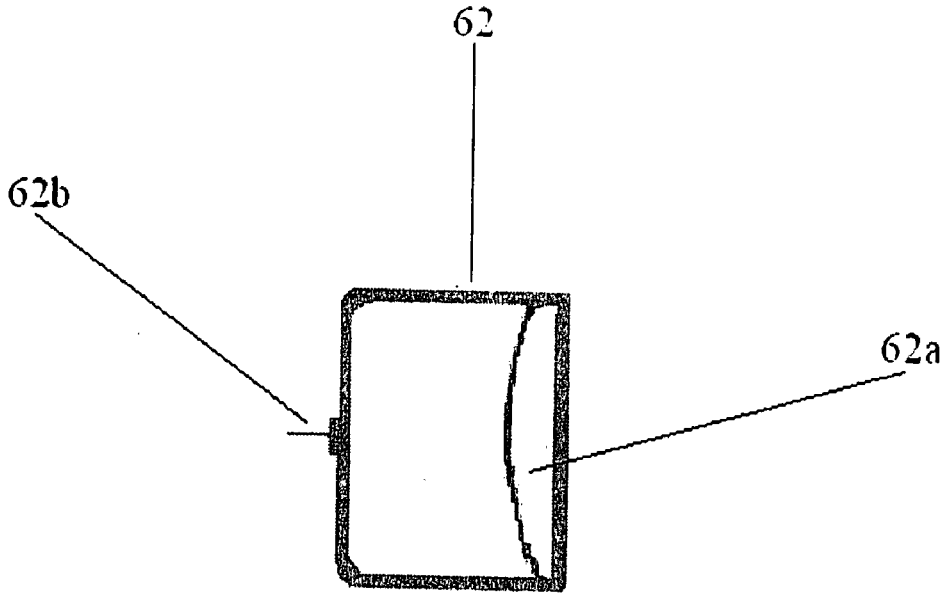
Figure 4D:
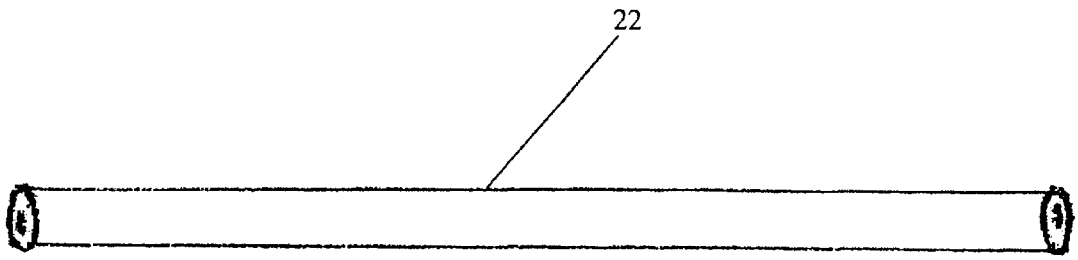
Figure 4E:
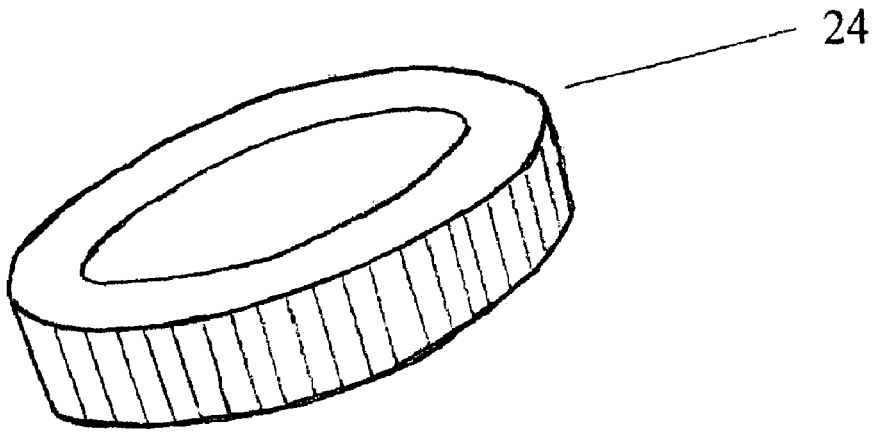

Referring to FIG. 2, the pen member 30 is slideably receivable in the knob member 24 and the elongated tube member 22 with a writing tip 32 extended from the bore of the knob member 24. The pen member 30 may be removed from the roller assembly 20 for use, or used while still received by the roller assembly 20 as the user desires.

The paper roll 40 surrounds and overlaps is positionable on the roller assembly 20. Preferably, the paper roll 40 has an overall length in the range of about 50–200 inches, preferably 72 inches. Most preferably, the paper roll 40 has a plurality of perforations in the range of about 5 to 100, preferably 42, to facilitate tearing the paper to a desired length prior to use.

In a preferred embodiment, the paper roll 40 has a width in the range of about 1–5 inches and is perforated every 2–20 inches. For example, the paper roll may have of width of about 4 inches and perforated every three inches. Thus, the user may utilize 4 inch by 3 inch notes dispensed from the paper roll 40.

The housing 50 is generally cylindrical with an open first end and a closed second end. The housing 50 is generally hollow and has a slot 56 through a perimeter wall. The slot 56 is used to feed paper from the paper roll 40 to the user as desired. The rolling assembly 20, pen member 30, and paper roll 40 are positionable within the housing 50. The knob member 24 extends from the open end 52 of the housing 50 to facilitate access by the user.

In an embodiment, the housing 50 further comprises a clip member 58 adjacent to the closed end 54. The clip member 58 is adapted for coupling the system 10 to clothing of the user. A holder 60 is utilized to keep system 10 together.

The cap member 61 is removably coupled to the housing 50 adjacent to the open end 52. The cap member 61 protects the pen member 30 and the knob member 24 when the system is not in use.

In a further embodiment, the cap member 61 is transparent.

In yet a further embodiment, the system 10 has an overall length in the range of about 2–10 inches, preferably 5½ inches and a circumference in the range of about 2–10 inches, preferably 2½ inches. The overall length of system 10 is not limited to the aforementioned circumference and length, but can be adapted for each user to increase or decrease the dimensions of system 10.

In use, the user removes the cap member 61 from the housing 50, unrolls the desired length of paper from the paper roll 40 through the slot 56 and tears off the paper at a perforation. The user may then write with the pen member 30 while the pen member 30 is within the roller assembly 20, or the user may remove the pen member from the roller assembly 20 prior to use. Alternately, the user may write on the paper and roll 40 the paper back into the housing 50 to manually store and keep the written information inside the pen member 30 for reviewing and later use.

FIGS. 4A through 4D are additional schematic perspective views of the note pen system. This note pen system is different from FIGS. 1–3 in that this note pen includes a capholder member 62 and a bendable portion 64. The bendable portion 64 is part of the housing 50. Bendable portion includes a plurality of notches 65*b*, 65*d* that aligns with a plurality of catches 65*a* and 65*c* that allows the slot 56 to be opened and closed to allow the paper roll 40 to be rolled into and out of the housing 50. Inside the housing 50 is the capholder member 62, which is connected to an interior apex of the housing 50 that holds a second end of the elongated tube member 22 in place inside of the housing 50 while allowing the paper roll 40 to move freely outside of the housing 50. Capholder member 62 has a cup-like structure in which elongated tube member 22 fits in. Elongated tube member 22 is capable of rotating freely within the cup-like structure of capholder member 62. Capholder member 62 holds elongated tube member 22 in place by way of the walls and edge 62A of this cup-like structure—thereby preventing elongated tube member 22 from slipping out of its position. Protrusion 62B connects capholder member 62 with the inside or interior apex of container end 54 and keeps capholder member 62 in place within housing 50. In one embodiment, protrusion 62B may plug in to the inside or interior apex of container end 54. In another embodiment, protrusion 62B may be fused with the inside or interior apex of container end 54.

With respect, to the above description, it is to be realized that the optimum dimensional relationships for the parts of the invention, to include variations in size, materials, shape, form, function and manner of operation, assembly and use, are deemed readily apparent obvious to one skilled in the art, and all equivalent relationships to those illustrated in the drawings and described in the specification are intended to be encompassed by the present invention.

Therefore, the foregoing is considered as illustrative only of the principles of the invention. Further since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A note paper device comprising:

a roller assembly;

a housing configured to hold the roller assembly, wherein the housing includes a slot and a bendable portion, wherein the bendable portion is configured to allow the slot to be opened and closed;

a paper roll positioned around the roller assembly, wherein the paper roll is configured to be rolled in and out of the slot of the housing;

the roller assembly having an elongated tube member and a knob member;

said elongated tube member having a first and second end, wherein said knob member is coupled to said first end of the elongated tube member;

wherein said knob member having a bore extending therethrough where the bore is aligned with a center of said elongated tube member;

a pen member slideably receivable in said knob member and said elongated tube member with a writing tip extended from the bore of the knob member, said pen member being removable from said roller assembly for use; and a capholder member configured to hold the second end of the elongated tube member in place in the housing.

2. The note paper device of claim 1, wherein the housing comprises a clip member.

3. The note paper device of claim 2, wherein the clip member is configured to be coupled to a user's clothing.

4. The note paper device of claim 2, further comprising a holder which fits under the clip member.

5. The note paper device of claim 1, wherein the bendable portion includes a closure mechanism.

6. The note paper device of claim 5, wherein the closure mechanism includes a plurality of notches and catches.

7. A note paper device comprising:

a roller assembly;

a housing configured to hold the roller assembly, wherein the housing includes a slot;

a paper slot roll surrounds the roller assembly, wherein the paper roll is configured to be rolled in and out of the slot of the housing;

the roller assembly having an elongated tube member and a knob member;

said elongated tube member having a first and second end, wherein said knob member is coupled to said first end of said elongated tube member;

wherein said knob member having a bore extending therethrough where the bore is aligned with a center of said elongated tube member;

a pen member slideably receivable in said knob member and said elongated tube member with a writing tip extended from the bore of the knob member, said pen member being removable from said roller assembly for use;

a capholder member configured to hold the elongated tube member in place in the housing; and a cap member configured to protect the pen member, wherein the cap member is removably coupled to the housing.

8. The note paper device of claim 7, wherein the cap member is configured to protect the knob member.

9. The note paper device of claim 7, wherein the cap member is transparent.

10. The note paper device of claim 7, wherein the capholder member is connected to the housing.

11. The note paper device of claim 10, wherein the capholder member is connected to an interior apex of the housing.

* * * * *